US009540767B2

(12) United States Patent
Vuorinen et al.

(10) Patent No.: US 9,540,767 B2
(45) **Date of Patent: *Jan. 10, 2017**

(54) METHOD FOR BLEACHING PULP

(71) Applicants: Kemira Oyj, Helsinki (FI); Andritz Oy, Helsinki (FI); UPM-Kymmene Corporation, Helsinki (FI); Stora Enso Oyj, Helsinki (FI); Metsä Fibre Oy, Metsä (FI)

(72) Inventors: Tapani Vuorinen, Espoo (FI); Anna-Stiina Jääskeläinen, Espoo (FI); Andreas Lindberg, Helsinki (FI)

(73) Assignees: KEMIRA OYJ, Helsinki (FI); ANDRITZ OY, Helsinki (FI); UPM-KYMMENE CORPORATION, Helsinki (FI); STORA ENSO OYJ, Helsinki (FI); METSÄ FIBRE OY, Helsinki (FI)

( * ) Notice: Subject to any disclaimer, the term of this patent is extended or adjusted under 35 U.S.C. 154(b) by 31 days.

This patent is subject to a terminal disclaimer.

(21) Appl. No.: 14/390,051

(22) PCT Filed: Apr. 3, 2013

(86) PCT No.: PCT/FI2013/050360

§ 371 (c)(1),
(2) Date: Oct. 2, 2014

(87) PCT Pub. No.: WO2013/150184

PCT Pub. Date: Oct. 10, 2013

(65) Prior Publication Data

US 2015/0152600 A1 Jun. 4, 2015

(30) Foreign Application Priority Data

Apr. 3, 2012 (FI) ..... 20125378

(51) Int. Cl.
*D21H 17/07* (2006.01)
*D21H 21/32* (2006.01)
(Continued)

(52) U.S. Cl.
CPC ..... *D21C 9/12* (2013.01); *D21C 9/1036* (2013.01); *D21C 9/14* (2013.01); *D21C 9/144* (2013.01);
(Continued)

(58) Field of Classification Search
CPC ..... D21C 9/12; D21C 9/123; D21C 9/126; D21C 9/14; D21C 9/142; D21C 9/144; D21C 9/1036
See application file for complete search history.

(56) References Cited

U.S. PATENT DOCUMENTS 4,298,428 A 11/1981 Breslin et al.
4,594,184 A 6/1986 Cook et al.
(Continued)

FOREIGN PATENT DOCUMENTS

WO 8703313 A1 6/1987
WO 9601263 A1 4/1996
(Continued)

OTHER PUBLICATIONS

Szabo et al.,Utilization of NaClO and H2O2 as a Source of the Singlet Oxygen for the Environmental Bleaching of Pulp, 1993, Cellulose Chem. Technol., 28, p. 183-194.*
Kanofsky, Catalysis of the Singlet Oxygen Production in the reaction of Hydrogen Peroxide and Hypochlorous acid by DABCO, 1986, Biochemical and Biophysical Research Communications, vol. 134, No. 2, p. 777-782.*
National Board of Patents and Registration of Finland, Search Report of Patent Application No. 20125378, dated Feb. 12, 2013.

*Primary Examiner* — Anthony Calandra
(74) *Attorney, Agent, or Firm* — Berggren Inc.

(57) ABSTRACT

A method for bleaching pulp is provided. In the method at least one tertiary amine compound is introduced into a process stage of bleaching. This process stage is a stage which comprises mixing pulp and a chlorine compound capable of bleaching.

19 Claims, 7 Drawing Sheets

(51) Int. Cl.

| | |
|---|---|
| ***D21C 9/12*** | (2006.01) |
| ***D21C 9/14*** | (2006.01) |
| ***D21C 9/10*** | (2006.01) |
| *D21H 17/66* | (2006.01) |
| *D21H 17/00* | (2006.01) |

(52) U.S. Cl.
CPC ..... *D21H 17/07* (2013.01); *D21H 21/32* (2013.01); *D21H 17/66* (2013.01); *D21H 17/74* (2013.01)

(56) References Cited

U.S. PATENT DOCUMENTS

| | | | | |
|---|---|---|---|---|
| 4,740,212 | A * | 4/1988 | Yant ..... | D21C 9/12 162/73 |
| 6,331,192 | B1 | 12/2001 | Jäkärä et al. | |
| 6,706,143 | B1 | 3/2004 | Tsai | |
| 8,128,784 | B2 | 3/2012 | Vilpponen et al. | |

FOREIGN PATENT DOCUMENTS

| | | | |
|---|---|---|---|
| WO | 2012168562 | A1 | 12/2012 |
| WO | 2013150184 | A1 | 10/2013 |
| WO | WO2015018908 | A1 * | 2/2015 |

* cited by examiner

METHOD FOR BLEACHING PULP

The present invention relates to a pulp bleaching process. More specifically, the invention relates to the use of amine as a catalyst in bleaching.

BACKGROUND

In chemical pulping, wood chips are digested with the aid of a chemical solution to solubilize a portion of the lignin therein effecting the removal of the lignin. Typically, these digestive procedures comprise sulfite, sulfate (Kraft), soda and modified sulfite processes. Digestion takes place either in a continuous mode or in a batch digestion process.

Once the wood chips have been digested, the resulting pulp material is generally dark coloured cellulose fibres, namely brown stock. This material is called unbleached pulp. The dark colour means that not all of the lignin has been removed during digestion and that the remaining lignin has been chemically modified. The pulp suspension coming from the digestion process contains dissolved organic material and used inorganic cooking chemicals. The goal in brown stock washing after the digestion is to recover as much dissolved organic substance as possible for energy production and as much of the valuable inorganic chemicals as possible for regeneration with a minimum amount of dilution.

By removal of lignin the wood fibers are allowed to separate from each other in order to enable the formation of a fiber web. The bleaching is needed to further increase the brightness of the pulp. After washing the first bleaching stage is typically oxygen delignification, where oxidized white liquor or/and sodium hydroxide is used for delignification. In the modern fibre lines knotting, screening and washing are performed after the oxygen delignification. The filtrate from the washing after oxygen delignification is used as a washing liquid in brown stock washing i.e. countercurrent washing.

Pulp from digestion process and oxygen delignification inevitably contains unwanted solid material. Some of the chips may not have been cooked properly, and some of the fibrous material may not be completely in the form of individual fibres. Contaminants other than wood may also enter cooking together with the chips. The purpose of knotting i.e. removal of knots and screening is to remove impurities and unfiberized particles from the main pulp stream to reduce the bleaching chemical consumption. In older fibre lines or if vacuum filters and wash presses are used in washing, the knotting is done after the digestion process.

Subsequently, the bleaching is often a multi-stage process employing chlorine, chlorine dioxide, oxygen, ozone, hydrogen peroxide, sodium hydroxide, peroxy acids, enzymes or a mixture of thereof. Still today, chlorine dioxide is a preferred choice for the bleaching chemical in many countries. Chlorine dioxide process has several advantages such as good bleaching capacity compared to e.g. hypochlorite, and it provides good strength and brightness values for the resulting pulp. Despite of its extensive use the chlorine dioxide process is not without drawbacks. Even though the price of chlorine dioxide is competitive compared to several other chemicals the equipment costs and loading on water systems cause pressure to decrease its consumption or even to find alternative bleaching solutions.

The reasons for the great consumption of the bleaching chemicals comprise side reactions wherein the chemical is consumed without any effect on the pulping product quality.

For example, heavy metals bound to carboxylic acid groups tend to increase the bleaching chemical consumption by decomposing the chemicals, as well as chemical constituents formed or liberated during pulping, such as hexenuronic acid groups, which react further with the bleaching chemical.

Several known methods are discussing the removal of metals by e.g. the use of chelating agents or complexing agents of various types. Complexing agents of tertiary amine class such as DTPA (diethylene triamine pentaacetic acid), have been used in pulping processes for removal of metals from certain pulping stages, such as the oxidizing stage, in order to provide suitably long reaction times for the oxidizing agents such as hydrogen peroxide the decomposition of which the metals tend to catalyze.

In pulping most of the lignin is removed in digestion and only a small portion, a few percent, remains in the pulp slurry. In order to further reduce this remaining lignin content considerable amount of bleaching chemicals is required in proportion to the amount of the residual lignin. This suggests that the presently applied bleaching methods or chemicals are nonetheless inefficient.

Hexenuronic acid is formed during Kraft pulping through modification of the hemicellulose constituent in wood. During bleaching, the electrophilic intermediate of chlorine dioxide, such as hypochlorous acid, is readily reacting with hexenuronic acid resulting in increased consumption of the bleaching chemical. Typically, the removal of hexenuronic acid from pulp prior to bleaching is carried out using the process of selective acid hydrolysis which results in conversion of hexenuronic acid into 2-furoic acid, formic acid and 5-carboxy-2-furaldehyde. Unfortunately, the acid hydrolysis process is a time consuming step.

EP0786029B1 discloses a method for removal of hexenuronic acid in cellulose pulp by heat treatment. In this method cellulose pulp manufactured by sulfate or alkaline process having a kappa number less than 24 is treated at a temperature from 85 to 150° C., at a pH of 2-5 for a period of time from 5 min to 10 h. This treatment results in removal of at least 50% of the hexenuronic acid groups and decreases the kappa number by 2-9 units.

WO87/03313 discloses a process for bleaching pulp comprising the use of a premixture based on hypochlorous acid and further comprising a halogen salt, chlorine dioxide and/or a nitrogen compound, such as hexamethylenetetramine. This premixture is added to the pulp for minimizing fiber degradation and enhancing brightness. The bleaching time for this type of bleaching composition is 2-4 hours and the optimum pH range is from 2 to 6.

U.S. Pat. No. 4,298,428 discloses a method for improving chemical pulp strength and brightness by using hypochlorite bleaching wherein the pulp slurry further contains 0.01-0.5% by weight of an amine compound selected from the group consisting of ethylamine, methoxypropylamine, monoethanolamine, n-butylamine, 3-aminopropanol, isopropylamine, ethylenediamine, aniline, 2-amino-2-methylpropanol, 2-aminopropanediol, triethylenetetramine, 1,3-diaminopropane, diaminohydroxypropane, ethylenediamine, hexamethylenediamine and morpholine.

The efficiency of the presently used bleaching chemicals needs to be improved in order to avoid the typical delay times of several hours in a bleaching step. The consequence of the slow reaction rates and long delay times contributes to the huge size of the used reactors. Another drawback is the low selectivity of the reactions taking place. Valuable bleaching chemical is consumed in side reactions competing for the same chemical and not for the removal of hexenuronic acid. Moreover, more efficient recycling enabling a better closed circulation would be highly desired and beneficial for diminishing the environmental impact due to bleaching.

SUMMARY OF THE INVENTION

It is an object of the present invention to provide a bleaching method or process which is fast i.e. effective in reducing the time required for the pulp to reside in a bleaching stage.

Another object of the present invention is to increase the bleaching stage efficiency by reducing the amount of bleaching chemicals required to provide the necessary bleaching effect.

Yet, a further object is to provide savings in energy and material costs and time without sacrificing the resulting pulp quality.

These objects are attained by means of a method according to claim 1.

It has now been surprisingly found by the inventors of the present invention that a catalytic amount of a tertiary amine compound introduced into a bleaching step and brought into contact with a bleaching chemical is able to provide an enhanced bleaching effect.

In chemical pulp bleaching the time required for the pulp to reside in a bleaching step is dramatically reduced when using the method of the present invention. The bleaching reactions are speeded up from hours, into a few minutes or less. This increases the throughput at the bleaching stage, enabling the use of smaller bleaching reactors, and decreases the overall process time.

The selectivity of the bleaching reaction is enhanced. The reactions are better focused on the chemical species responsible for brightness increase. Less bleaching chemical is needed as the amount of undesired side reactions decreases or as the oxidation and/or chlorination can be performed more efficiently using less active chlorine. Typically, the active chlorine consumption can be as high as 45 kg/ton wherefrom two thirds may be used in undesired side reactions.

A further advantage of the present invention is that the pH range required for the bleaching step is a broad one. Excellent bleaching results have been obtained in both acidic and alkaline pH ranges. The broad operative range enables the use of the present process in varying bleaching steps without any need for prior pH adjustment by additional acid or base.

Yet, another versatility advantage is that the method of the present invention is not temperature sensitive and thus no heating or cooling prior to the bleaching stage of the present invention is required providing energy savings.

A combined effect of the decreased time for bleaching and the selectivity enhancement of the reaction routes lead especially to decreased amount of slow side reactions due to less time available thereto.

FIGURES

Figure 5:
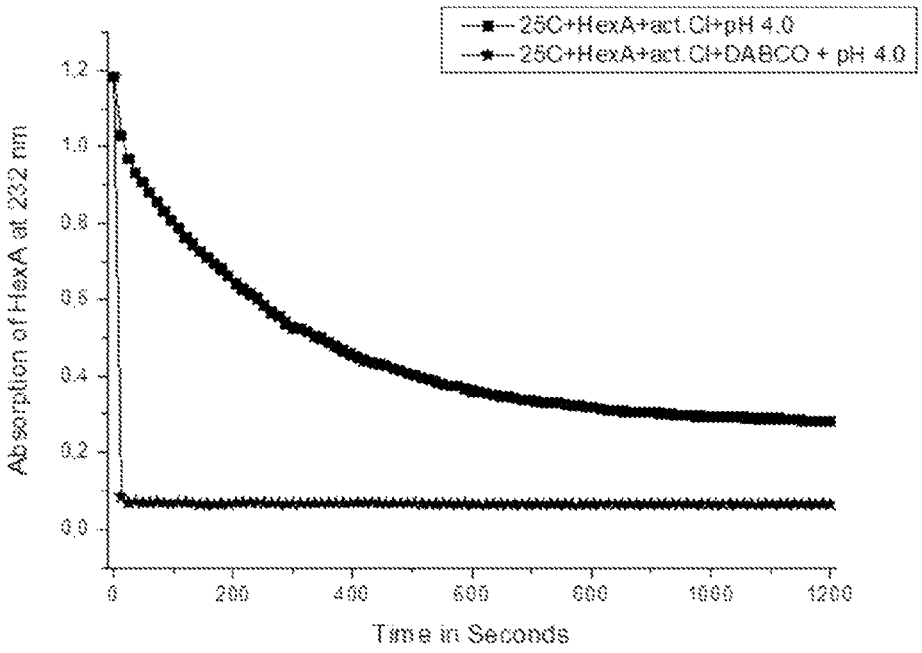

FIG. 5 further illustrates the decrease of the amount of hexenuronic acid in time.

Figure 6:
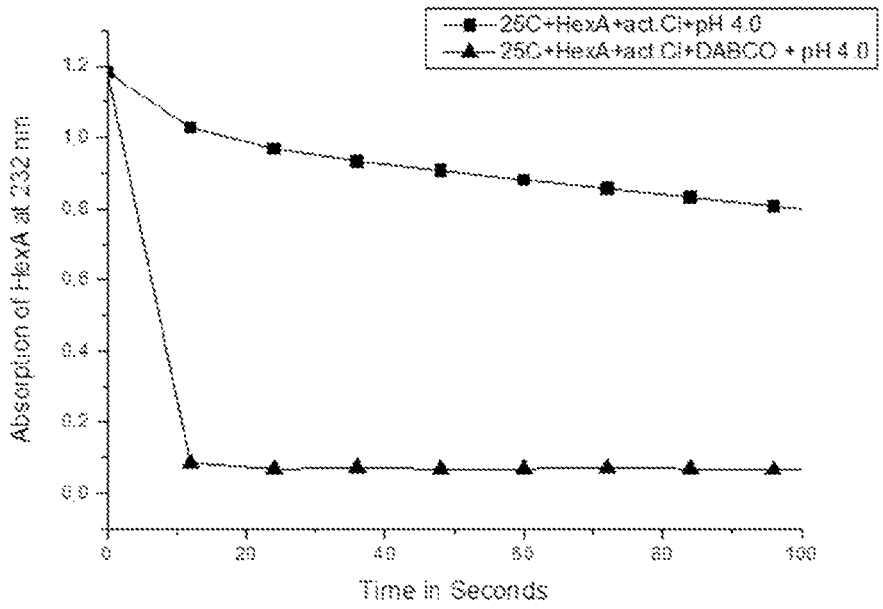

FIG. 6 is a blow up view illustrating the speed of the reaction with the amine.

Figure 7:
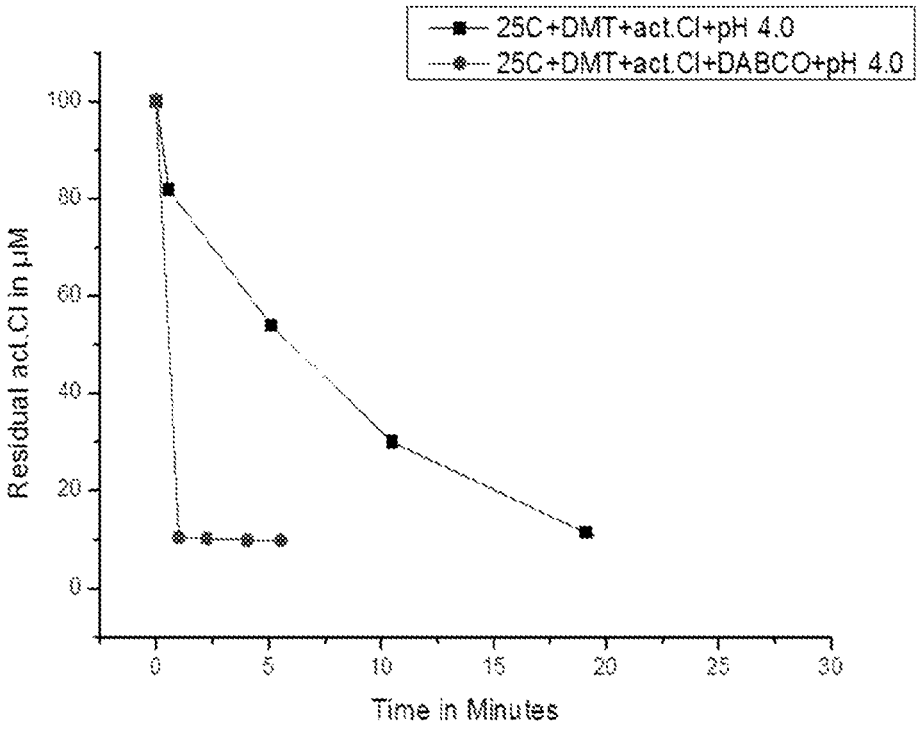

FIG. 7 shows a detailed view of the lignin reaction rate.

DETAILED DESCRIPTION OF THE INVENTION

By the term "chemical pulp" is meant pulp ready to enter the bleaching process which has a kappa number of 50 or less i.e. wherefrom at least 80% of the lignin has been removed in pulping, or preferably by pulping and oxygen delignification whereby the kappa number may be lowered to below 40.

By the term "active chlorine" is meant the oxidizing potential of the bleaching chemical solution regardless of the bleaching chemical quality or valence. Typically, the amount of added active chlorine i.e. active chlorine charge is expressed in kg act. Cl/ton of pulp. This value typically decreases over time and the initial value is commonly determined by sodium thiosulphate titration. The amount of active chlorine present may be expressed in percent by weight of the pulp dry matter.

In the method of the present invention the pulp bleaching process is enhanced by introducing a tertiary amine compound into the bleaching process.

By the term "enhancement" is meant that the processing time in the bleaching process is decreased and/or the selectivity of the bleaching reaction is increased. The amount of the chemicals required for obtaining the desired bleached pulp properties, such as low kappa number and/or high ISO brightness, is decreased without sacrificing said desired properties.

By the expression "anti-planar" is meant a near planar conformation of a chain of atoms A-B-C-D wherein terminal groups A and B are located on opposite sides of the central line passing through atoms B and C. According to IUPAC's definition the torsion angle i.e. angle between bonds A-B and C-D when observed in the direction of bond B—C in anti-planar (antiperiplanar) conformation, is 180±30° contrary to syn-planar (synperiplanar) conformation wherein the torsion angle is 0±30°.

Pulping may be carried out by a number of different methods and process step sequences, namely chemical, mechanical or chemi-mechanical methods. In the method of the present invention chemically produced pulp is used, preferably, pulp produced by the Kraft pulping process. In the process of pulping majority of lignin in the wood chips, at least about 80%, is removed allowing the wood fibers to separate from each other. Once lignin has been removed, the free fibers can form a fiber web on a forming fabric of the papermaking machine.

However, the different pulping methods result in varying type and amount of chemical lignin and carbohydrate structures in pulp. The main focus in applying the method of the present invention is in Kraft pulping where the alkaline pulping conditions provide significant amount of hexenuronic acid to the pulp the amount of which has a strong influence in the pulp bleaching result. In the soda pulping process, polysulfide cooking and other alkaline pulping processes form hexenuronic acid in pulp but typically in sulfite process hexenuronic acid is not present. Generally, the method of the present invention can be utilized at least when hexenuronic acid, lignin or corresponding aromatic chemical structures remain in pulp at moderate or low concentrations.

In the Kraft pulping process the majority of glucomannan and a smaller fraction of xylan dissolved during cooking and 4-O-methylglucuronic acid, a component of xylan, is structurally modified into hexenuronic acid. This conversion is dependent on the pulping temperature, retention time, the amount of hydroxyl ions in the cooking liquor and the total ionic strength of the slurry. The xylan component is typically more abundant in hardwood pulp that in softwood pulp.

The method of the present invention is suitable for use in both hardwood and softwood pulp processing. Hardwood pulp typically contains less lignin and more hexenuronic acid compared to softwood pulp.

In the method of the present invention for bleaching pulp, at least one tertiary amine compound is introduced into a process stage of the pulp bleaching process which process stage comprises mixing the pulp to be bleached and a chlorine compound capable of bleaching i.e. the bleaching chemical.

In one embodiment of the present invention the bleaching time for hardwood pulp bleaching process is reduced from the conventional one to four hours into a few minutes by using the method of the present invention. This reduction of bleach processing time enables to reduce processing equipment size considerably.

Another embodiment the method of the present invention provides an efficient solution for softwood pulp bleaching which is conventionally chemical consuming due to inefficiency of the chemicals towards the particular type of lignin present therein. By the use of the method of the present invention the chemical consumption may be cut into half.

In yet another embodiment, the method of the present invention offers an alternative to the use of ozone in bleaching. In ozone bleaching also other constituents besides lignin are reacted, leading to undesired side effects such as oxidation of cellulose. The selectivity of the present method reduces the disadvantages emerging from the side reactions.

The main aim of the bleaching process following the pulping is to improve the optical properties of the pulp, to decrease the amount of impurities and to alter the mechanical properties of the pulp to match the requirements of the final product. Typically, bleaching is carried out in several consecutive stages or steps using varying bleaching chemicals. These chemicals may be categorized according to the types of reactions they participate in. The reactions during bleaching may be of electrophilic, nucleophilic or of radical type. Electrophilic bleaching chemicals include elementary chlorine, hypochlorous acid, ozone and peroxyacids, whereas nucleophilic chemicals include hydrogen peroxide and hypochlorite. Oxygen and chlorine dioxide are the radical bleaching chemicals typically used.

In one embodiment of the present invention the kappa number of the pulp entering the bleaching process from pulping is less than 30, preferably from 15 to 30.

In another embodiment of the present invention the kappa number of the pulp entering the bleaching process from pulping and pre-bleaching is less than 20, preferably from 10 to 20.

In yet another embodiment of the present invention the kappa number of the pulp entering the bleaching process from pulping after oxygen delignification or bleaching is less than 16, preferably less than 14.

In an industrial mill scale the bleaching process is preferably carried out in series of bleaching stages. Only in special cases the bleaching is carried out only in one single stage. Typically, the required pulp quality is reached with several bleaching stages using different bleaching chemicals.

The method of the present invention may be applied in any or several of the bleaching stages residing in or between the pre-bleaching and the post bleaching stages wherein the kappa number is preferably less than 20 and more than 1, respectively.

A bleaching stage comprises typically a feed pump of the pulp, required amount of mixing steps, reaction vessel and the washer. Each bleaching stage has an optimum temperature and pH and is therefore equipped with a temperature control with heating and cooling facilities and a pH control arrangement. The retention time i.e. delay time of the stage is controlled by the size of the retention vessel. If the products of a bleaching reaction do not disturb the following stage(s) several bleaching stages may be connected without a need for an intermediate washing step.

In the present invention varying chlorine compounds capable of bleaching may be applied. Preferably, these chlorine bleaching compounds comprise chlorine dioxide, elementary chlorine, hypochlorous acid and chlorite or hypochlorite salts. Elementary chlorine reacts with olefinic and aromatic lignin, whereas chlorine dioxide primarily reacts with phenolic lignin structures and carbon-carbon double bonds. Chlorite and hypochlorite salts react mainly with the carbonyl structures of chromophores. In the method of the present invention one or more bleaching chemicals may be applied together or separately depending on the desired bleaching process stage or sequence. Most preferably, the bleaching chemical comprises chlorine dioxide or hypochlorous acid. Both of these bleaching chemicals are also able to provide oxygen for the lignin reactions. Specifically, the chlorine dioxide is produced at the site of bleaching, and is readily available immediately before application. Suitable salts for the chlorite or hypochlorite compounds are metal salts such as alkali or alkaline earth metal salts. Preferably, these metal salts are selected from the group consisting of Na, K, Mg or Ca which are commercially available in industrial scale. Most preferably, the salts are Na salts which are especially suitable as they do not provide any additional elements to the bleaching process.

In a preferred embodiment the beaching chemical is chlorine chemical capable of forming in situ hypochlorous acid, most preferably the beaching chemical is chlorine dioxide. The formation of hypochlorous acid may take place before, during or after addition into the selected bleaching stage. Preferably, the formation of the hypochlorous acid is enabled at the desired bleaching stage. For example the reaction of chlorine dioxide with an aromatic chemical species such as lignin is able to produce hypochlorous acid and/or chlorite further reacting into hypochlorous acid.

Figure 1:
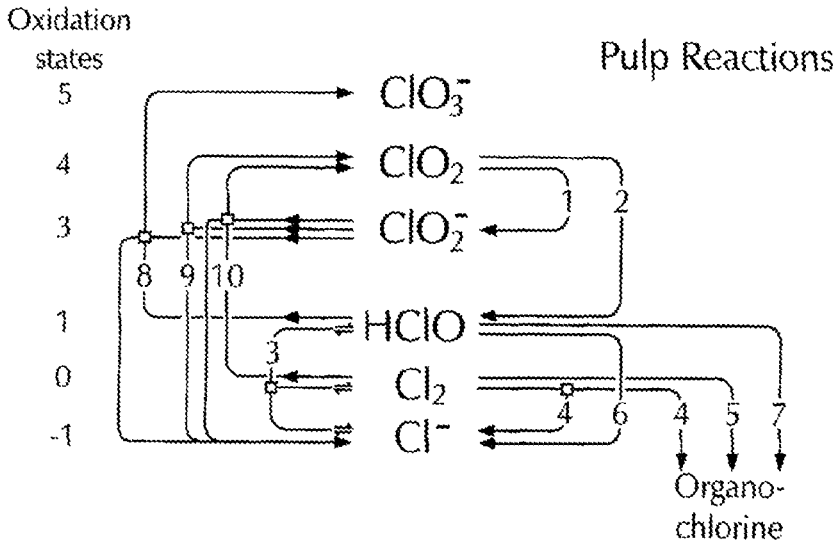
FIG. 1 depicts the reactions of chlorine dioxide in pulp bleaching.

Hypochlorous acid is a strong oxidant and has potential in reacting with both lignin and hexenuronic acid. During pulp bleaching the applied chlorine dioxide will be reduced in several steps as shown in FIG. 1 (Gullichsen, J. Papermaking science and Technology Book 6A Chemical Pulping, 2000, p. 171). Chlorine dioxide may be first converted into chlorite and hypochlorous acid with oxidation stages of +3 and +1, respectively (reactions 1 and 2 in FIG. 1). Hypochlorous acid and chlorine are in equilibrium and are both able to react with either lignin, hexenuronic acid or chlorite. Ultimately, the bleaching reactions result in formation of chloride and chlorate with oxidation stages of −1 and +5, respectively. In acidic conditions chlorite may also self-decompose forming hypochlorous acid and chlorate.

Hypochlorous acid, as such, has been used as a separate bleaching chemical in the bleaching of pulp. However, due to its adverse effects, as hypochlorite, on pulp viscosity and strength properties along with the formation of chloroform its use has become limited.

The tertiary amine compound to be used in the method of the present invention is preferably an aliphatic tertiary amine. More preferably, this amine is a compound having the general formula of $$R_1R_2R_3N \quad (1)$$

wherein $R_1$, $R_2$, and $R_3$ are the same (R1=R2=R3) or different alkyl groups, which groups are attached to the central nitrogen (N) atom.

The amine of the present invention is able to form a chloroammonium cation with the chlorine bleaching compound, the stability of which depends on its stereochemistry, structure i.e. positioning and quality of the alkyl groups.

If a carbon atom attached directly to the central nitrogen atom is bonded to a hydrogen atom and an anti-planar conformation (H—C—$N^+$—Cl) is formed the cation will decompose rapidly. Similarly, if an alkyl group attached on the central nitrogen atom contains two carbon atoms bonded directly to each other and the second carbon atom contains a heteroatom (X) such as oxygen, nitrogen or sulfur provided that these structures are able to adopt a near anti-planar conformation (X—C—C—$N^+$—Cl), the chloroammonium cation may again be easily broken. This type of structure is unlikely to provide a sufficiently stable compound. These types of tertiary amines could be used provided that the stability of the formed cation is high enough. However, compounds having a non-anti-planar conformation are the most preferred ones providing a clear experimental effect on hexenuronic acid or lignin removal and decrease in kappa number.

Bleaching of pulp is carried out in a heterogeneous suspension of pulp fibers in an aqueous medium. In addition to the various chemical reactions, mass transfer between the liquid and the fiber cell wall plays an important role. For very rapid reactions the mass transfer can be the rate-limiting phenomenon. Those tertiary amines that form stable enough chloroammonium cations will provide the best alternatives. There are several chloroamine compounds the most of which tend to be very unstable and which are thus not particularly effective in the method of the present invention. The most preferred candidates were experimentally found to exhibit an adequate stability in order to provide a very clear effect.

In a preferred embodiment of the present invention, the tertiary amine compound is a non-planar polycyclic N-substituted compound whereby the decomposition of the molecule is sterically hindered when forming a chloroammonium cation. Preferably, the tertiary amine compound is a non-planar fused polycyclic N-substituted compound, more preferably non-planar fused bicyclic N-substituted compound, wherein at least one nitrogen atom is in a bridgehead position. The stability of these compounds is increased as the bicyclic fused structure efficiently prevents the formation of the anti-planar H—C—$N^+$—Cl or X—C—C—$N^+$—Cl configuration when reacted into the chloroammonium cation form.

In a yet preferred embodiment the formed quaternary chloroammonium cation comprises a non-anti-planar H—C—$N^+$—Cl or X—C—C—$N^+$—Cl conformation, unable to decompose without a delay of at least 1 sec.

More preferably, the tertiary amine compound is of the general formula (2)

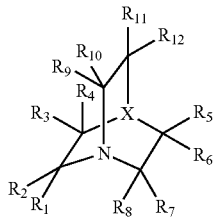

wherein X is N or C, and $R_1$-$R_{12}$ is the same or different alkyl group, halide, ester or alkoxide or hydrogen. Preferably, the alkyl is selected from the group consisting of lower alkyls of C5 or less, more preferably the alkyl is methyl or ethyl. Preferably, the halide is chloride. Preferably, the ester is selected from the group consisting of lower esters of C5 or less, more preferably the ester is selected from the group consisting of formate, acetate and propionate ester. Preferably, the alkoxide is methoxide or ethoxide.

In a preferred embodiment, the tertiary amine is quinuclidine. Quinuclidine (structure 1) has a fused bicyclic structure wherein the nitrogen atom exists in a bridgehead position which configuration excludes the possibility for an anti-planar H—C—$N^+$—Cl structure.

In another preferred embodiment the tertiary amine is triethylenediamine (DABCO). Triethylenediamine (structure 2) does not form an anti-planar X—C—C—$N^+$—Cl substructure.

Structure 1

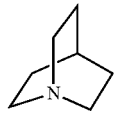

Structure 2

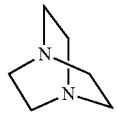

These amines were found to be stable enough to be able to provide a reasonable delay time of at least 1 s for chemical constituent migration during bleaching, and to provide a clear effect on the reactions with hexenuronic acid and lignin.

For example, DABCO is an industrially used and easily available commercial chemical which is not highly toxic and which does not decompose at high temperatures.

These tertiary amines readily react with added or in situ formed hypochlorous acid forming an electrophilic quaternary chloroammonium cation, which has proven to be stable enough and suitable for use as a catalyst in a bleaching stage of the pulp bleaching process.

According to the present invention contacting a catalytic amount of the above described tertiary amine with a mixture comprising unreacted hypochlorous acid and an organic agent containing unsaturated structures, such as hexenuronic acid or lignin, significantly increases the reaction rate of oxidation of the carbon-carbon double bond. It was found that the chloroammonium cation thus formed is capable of acting as a much stronger electrophile that the mere hypochlorous acid itself. This type of tertiary amine provides a catalytic effect to bleaching in the presence of a chlorine bleaching chemical.

Furthermore, the formed cation of the present invention does not exhibit any nucleophilic behavior whereas in its ionized form, as hypochlorite, hypochlorous acid does. This feature is believed to depress the possible side reactions proceeding via the nucleophilic reaction route. Therefore, the tertiary amine catalyst of the present invention provides excellent selectivity.

Certain tertiary amines are typically used in pulp industry as chelating agents. These include e.g. ethylenediaminetetraacetic acid (EDTA) and diethylenetriaminepentaacetic acid (DTPA). Both of these agents contain substructures that can form, after reaction with hypochlorous acid, an anti-planar —O—C—C—$N^+$—Cl conformation. For example, hexamethylene tetramine can form an anti-planar —N—C—$N^+$—Cl conformation.

In comparison with the tertiary amines, secondary ($R_1R_2NH$) and primary ($R_1NH_2$) amines are less efficient bleaching catalysts because their reaction products with hypochlorous acid are neutral ($R_1R_2NCl$ and $R_1HNCl$). Relatively low pH is needed to protonate the reaction products to form the more reactive chloroammonium cations ($R_1R_2HN^+Cl$ and $R_1H_2N^+Cl$).

In the method of the present invention the tertiary amine compound and the chlorine compound capable of bleaching are added into the pulp slurry or suspension in a way to enable the formation of a chloroammonium cation as depicted by the following reaction schema:

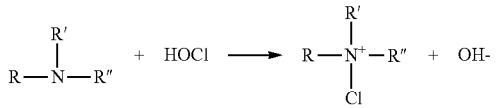

This quaternary chloroammonium cation is very strongly electrophilic and readily reacts with double bonds. The nucleophilic side reactions become thus depressed and the consumption of the oxidizing agent is decreased.

The bleaching stage may be any bleaching stage wherein the bleaching effect is desired to be enhanced provided that the original amount of lignin in the pulp is decreased to a kappa number of preferably less than 30. This chemical pulp bleaching stage is preferably a chlorine dioxide bleaching stage, more preferably a bleaching stage in or after the pre-bleaching and before the post bleaching. The process may further comprise several bleaching stages in sequence or parallel wherein the bleaching effect is enhanced by the method of the present invention. The bleaching stages may be separated by washing stages.

In a preferred embodiment of the present invention, the chlorine compound of the present invention is a compound that forms in situ hypochlorous acid at the bleaching stage once added into the pulp. The tertiary amine will readily react with the formed hypochlorous acid forming the above described chloroammonium cation.

The tertiary amine compound and the chlorine compound may be introduced in sequence or simultaneously. Preferably, the tertiary amine compound is added first into the pulp slurry of the desired bleaching process stage and subsequently the chlorine compound is introduced due to the high reactivity of the hypochlorous acid added or formed in situ. The adding is to be designed in a way to ensure the formation of the ammonium cation. The tertiary amine is preferably in the form of an aqueous solution whereby the control of introduction is easy and a homogenous mixing into the pulp slurry is enabled. The formation of the desired catalyst i.e. the catalytic effect may become suppressed or prevented if the tertiary amine or the hypochlorous acid reacts first with other constituents.

A catalytic amount of the tertiary amine compound is preferably introduced into the bleaching stage. The amount of amine is dependent on the pulp composition, bleaching conditions and pretreatments. Preferably, the amount of amine is less than 5 kg/ton, more preferably less than 3 kg/ton, most preferably less than 2 kg/ton, such as less than 1.5 kg/ton. When using pulp suspension free of any disturbing chemical compounds besides hexenuronic acid or lignin the sufficient amount of amine may be very low, even less than 1 μmol/l. Preferably, the amount in regular pulp bleaching process is at least 0.01 kg/ton, more preferably at least 0.1 kg/ton, most preferably from 0.1 to 1.5 kg/ton. In higher consistencies it is possible to use a lower amount of the catalyst.

The amount of chlorine compound to be added is advantageously defined in terms of the amount of added active chlorine. Preferably, the amount of active chlorine present at a bleaching process stage of the present invention is from 1 to 30 kg act. Cl/ton of pulp, preferable from 3 to 20 kg act. Cl/ton of pulp, more preferably from 5 to 15 kg act. Cl/ton of pulp. The active chlorine charge depends on the bleaching stage position, prior bleaching stages, the type of pulp and processing conditions. In yet another preferred embodiment the amount of amine catalyst is about 1% of the amount of active chlorine provided that the active chlorine comprises hypochlorous acid.

One advantage of the present invention is that the pH of the pulp slurry in the bleaching stage wherein the tertiary amine catalyst and the chlorine compounds are to be added may vary considerably. The method is not particularly pH sensitive. A broad pH range from 2 to 10 may be used without essentially decreasing the bleaching performance. This is particularly advantageous in view of the processing condition requirements for the process stages to be applied preceding the bleaching step and after the bleaching step, especially when several consecutive bleaching stages are necessary. An additional pH adjustment step is not required between the different stages. A minor decreasing influence of pH to kappa number can be seen within the alkaline side, in a range from 6 to 9 in the experiments made. However, it will be within the competence of a skilled person to optimize the pH for particular reactions conditions.

The preferred temperature at a bleaching stage according to the present invention at ambient pressure is below 100° C. for avoiding boiling of the aqueous slurry, preferably below 90° C., more preferably from 45-90° C. since most of the adjacent process stages are performed within this range. The aim is to avoid unnecessary temperature adjustments, energy consuming additional cooling or heating steps.

The pulp mean consistency is typically about 10% by weight of dry pulp. The method according to the present invention is preferably used within a range from 1 to 15% consistency, more preferably from 2 to 13%, most preferably from 3 to 12%. A lower consistency facilitates the mixing of the pulp slurry and homogenous distribution of the chlorine chemicals and the tertiary amine therein. However, by increasing the amount of dispersion medium may increase the chemical consumption.

The tertiary amine compound may be recovered and/or reused after bleaching from this process stage. It is optionally reused at the same stage or other stages. Alternatively, the recovered tertiary amine compound may be recycled to further use at the same process or to another process. Preferably, the filtrate from the pulp slurry is collected and recirculated. The reaction of the tertiary amine into the chloroammonium cation and back is reversible. The same tertiary amine containing filtrate may be recovered, preferably up to 90%, and reused several times.

In a preferred embodiment the filtrate from the bleaching stage is recycled partially or totally in the washer prior said stage. This will reduce the effluent amount needed in the bleaching stage and also reduce the need for fresh tertiary amine compound.

A conventional bleaching stage takes several hours, typically from 3 to 4 hours depending on the chemicals and processing conditions used. A long duration bleaching process may even be aimed at as the acid hydrolysation is known to be a slow process. In the method of the present invention the delay time in a bleaching stage is very short. The reactions of forming the chloroammonium cation and subsequent reactions with e.g. hexenuronic acid and/or lignin are very fast. The processing time in bleaching is cut at least into half compared to conventional bleaching. Preferably, the delay time in bleaching is only a few minutes, such as less than 10 minutes. Depending on mixing efficiency and practical considerations the delay time may preferably be even less than five minutes. As the actual reactions takes place in only a few seconds, the delay time is more preferably less than two minutes, even such as less than one minute, depending on the quality of the tertiary amine and the stability of the chloroammonium cation. The short reaction time passes the challenge of accelerating the bleaching process to mixing efficiency and equipment layout design. Furthermore, the fast reaction enables the use of smaller reactors or mixers and a continuous bleaching operation as, in practice, essentially no delay time due to reaction slowness is required.

In a preferred embodiment the pulp slurry is fluidized during mixing, facilitating a uniform distribution of the reacting chemicals.

In another embodiment the mixing of the chemicals into the pulp slurry is performed in a similar manner to the processing in an ozone stage.

In a preferred embodiment the Kraft pulping system includes at least cooking, washing and screening stages before the bleaching stage and preferably the oxygen delignification stage is also included. Due to the fact that the formed cation is very selective to hexenuronic acid, preferably this bleaching stage is in the beginning of those bleaching stages that remove hexenuronic acid or after those bleaching stages which have only little or no influence to hexenuronic acid. Therefore, the bleaching stage of the present invention is most preferably located before chlorine dioxide bleaching (D), ozone (Z), acid peroxide or chlorine (C) stage which remove hexenuronic acid during the reaction.

In another embodiment the bleaching stage of the present invention is located after oxygen or alkaline peroxide stages, namely after the bleaching stages which have minor influence to hexenuronic acid content.

The products of the catalytic amine reaction have low reactivity with other bleaching chemicals like $ClO_2$ or hydrogen peroxide resulting in that the bleaching step according to the present invention can be connected with these other stages without intermediate washing.

In a preferred embodiment the bleaching stage of the present invention, preferably using DABCO, is installed in the beginning of bleaching wherein the hexenuronic acid content is high, but the lignin content is suitable for final bleaching where the major part of the liquids are discharged to effluent treatment.

In a yet preferred embodiment, if the bleaching stage of the present invention is done in 2-6% consistency it is beneficial to locate said stage in the screen room. In this case the screen room is preferably after the post oxygen washing and the bleaching stage is integrated into the screen room process. After said bleaching stage the pulp enters a washing stage and it is subsequently pumped to the next bleaching stage. The chlorine content of pulp slurry is significant and therefore the materials of the equipment must be selected in a way that they resist corrosion.

A further advantage in using the bleaching of the present invention is that it is possible to use practically all common bleaching chemicals. One target is that bleaching can be performed in one or two stages after the bleaching of the present invention. However, the use of the bleaching of the present invention is not limited to bleaching chemicals or number of treatment steps.

The present invention is further illustrated by the following non-limiting examples.

EXAMPLES

The UV resonance Raman (UVRR) spectroscopic method was used to analyse the molecular structures of hexenuronic acid and lignin. The detected light scattering is expressed as a intensity of the spectrum as a function of Raman shift in Δcm-1. The values of 1657 cm-1 and 1608 cm-1 correspond to hexenuronic acid and lignin, respectively. The apparatus used was Renishaw 1000 UV Raman spectrometer with Leica DMLM microscope with a ×40 objective and Innova 300C FreD frequency—doubled Ar+ ion laser.

The kappa numbers were determined conventionally using SCAN-C 1:00 (Revised 2000) standard by titration as the combined total amount of lignin and hexenuronic acid present in a sample of pulp. Hexenuronic acid content was determined as described in Vuorinen, T et al., Selective Hydrolysis of Hexenuronic Acid Groups and its Applications in EFC and TCF Bleaching of Kraft Pulps, J. Pulp and Paper Science, 25:5 (1999) pp. 155-162.

ISO brightness values were measured conventionally according to ISO standard SCAN-CM 11:95 (Revised 1995) with reflectance measured at a wavelength of 457 nm. The value is a measure of the amount of visible blue light reflected from the surface of an opaque stack of pulp sheets.

Example 1

Oxygen delignified birch Kraft pulp obtained from an industrial pulp manufacturer was treated with triethylenediamine (from Sigma-Aldrich, Germany) and sodium hypochlorite (from Prolabo, Belgium).

The pulp was defined to have a kappa number of 13.9, ISO brightness of 51.4% and hexenuronic acid content of 58 mmol/kg. Triethylenediamine concentration in the pulp to be treated was adjusted to 0.1% by weight of pulp and the active chlorine charge of the sodium hypochlorite used was 0.5 or 1.0%. The pulp consistency was 10% by weight and a medium consistency mixer (MC) was used to provide efficient mixing.

After the initial control of pH by acid or alkali ($H_2SO_4$ or NaOH) and addition of triethylenediamine to the pulp, the MC reactor was closed and thermostated to 50 or 65° C. The solution of sodium hypochlorite was added to the suspension under vigorous stirring. After 10 min the reactor was opened and the pulp was washed with deionized water. The time frame of 10 min is due to practical operation of the reactor, but could have been even much shorter.

The pulps were analyzed for kappa number (SCAN-C 1:00) and ISO brightness (SCAN-CM 11:95) according to standard methods. Hand sheets of the pulps were prepared according to a standard method (ISO 5269) from acidified (pH 3) pulp suspensions. UV Raman spectra of the hand sheets were measured as described in Jääskeläinen, A.-s., et al. Quantification of lignin and Hexenuronic Acid in Bleached Hardwood Kraft Pulps: A New Calibration Method for UVRR Spectroscopy and Evaluation of the Conventional Methods, J. Wood Chemistry and Technology, 25:1-2 (2005), pp. 51-65.

Figure 2:
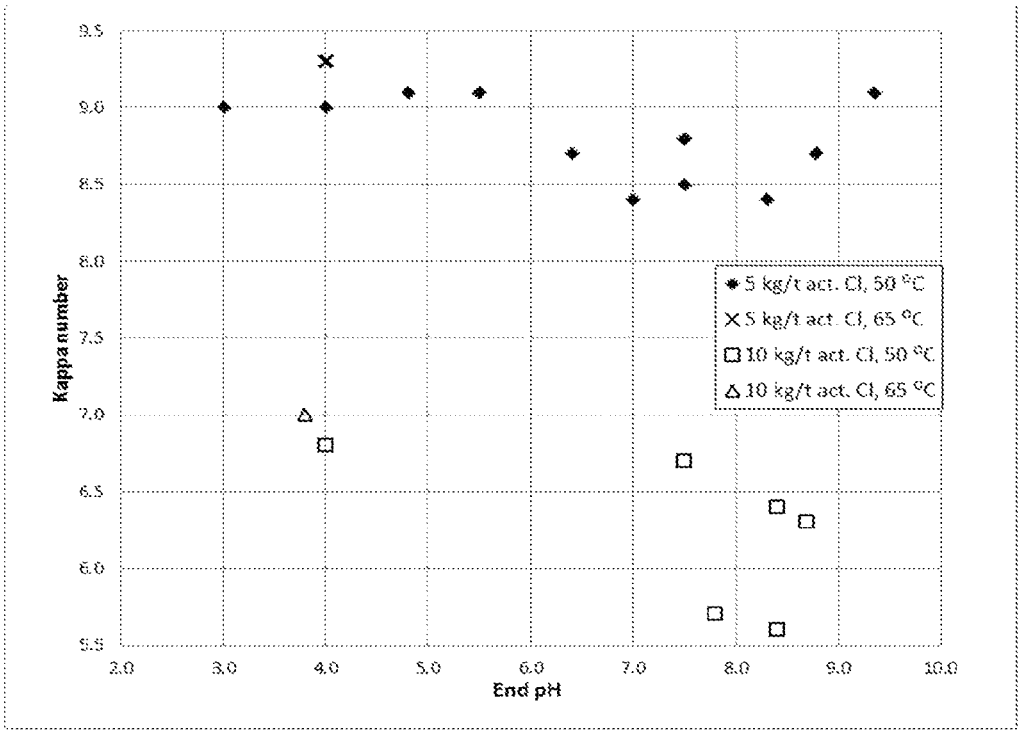
FIG. 2 illustrates the dependence of the bleaching process on pH, the amount of active chlorine and temperature.

The effects of the final pH, charge of active chlorine and temperature on kappa number are illustrated in FIG. 2.

At 50° C. the treatment with 0.5% active chlorine decreased the kappa number by 4.8-5.5 units while the use of 1.0% active chlorine charge led to 7.1-8.3 units' reduction in kappa number. The kappa number may be adjusted by the amount of active chlorine charge used.

The influence of the pH of the pulp seems to be minor. Several pH values were tested from 3 to 9.5 which all seem to provide a similar level change for the kappa number. It could be anticipated that the most pronounced pH effect is obtained at values near neutral but these value only slightly exceed the experimental fluctuations.

Treating the pulp at 65° C. instead of 50° C. leads to only 0.2-0.3 units higher kappa number. Therefore, it is concluded that the temperature dependence of the used method is moderate.

Figure 3:
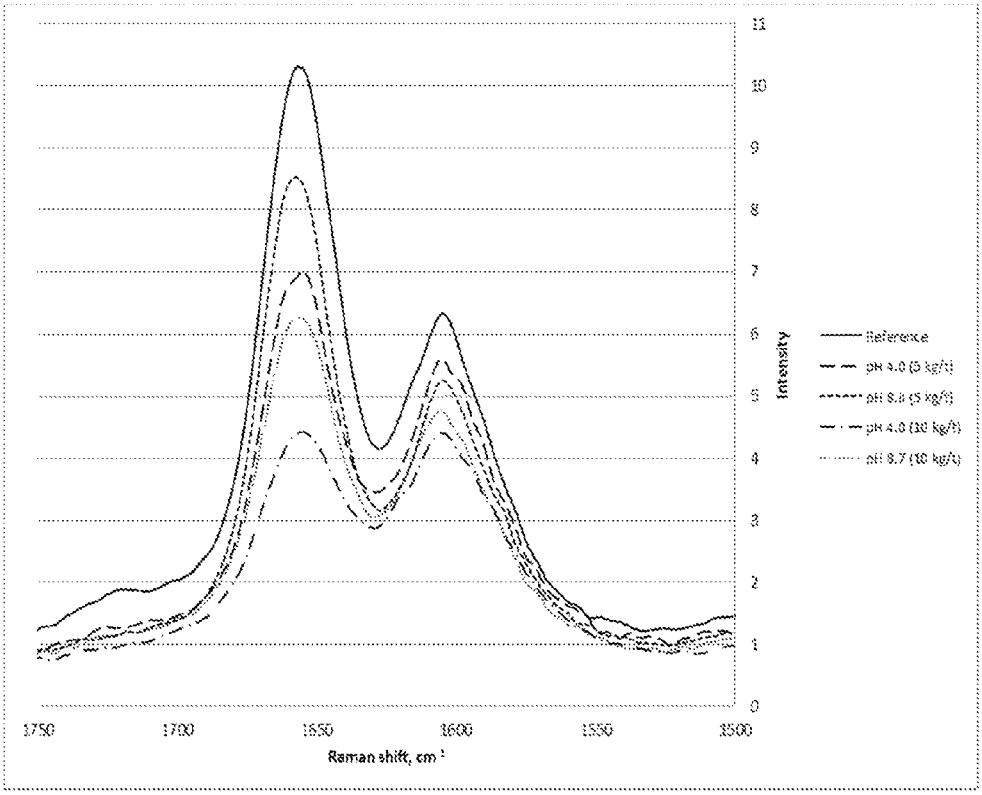
FIG. 3 shows the changes in the UVRR spectra of the pulp during bleaching.

Analysis of the pulp sheets by UV resonance Raman spectroscopy (FIG. 3) reveals that both hexenuronic acid (peak at 1657 cm-1) and lignin (peak at 1608 cm-1) are degraded in the treatments although the decrease in the content of hexenuronic acid was more significant based on the decrease in peak height and peak area of the Raman shift.

Example 2

Pulps treated with triethylenediamine and sodium hypochlorite according to Example 1 were subjected for a second bleaching treatment with sodium hydroxide (0.33-0.65% by weight of pulp), hydrogen peroxide (0.6% by weight of pulp) and oxygen (300 kPa pressure). Magnesium sulfate (0.2% by weight of pulp) was used as a stabilizer for hydrogen peroxide. The treatments were carried out in a Teflon coated rotating reactor at 10% consistency. The reactor was heated to 85° C. and kept for 90 min at this temperature. The treatment was interrupted by cooling the reaction vessel in cold water and washing the pulp suspension with deionized water. Results from the treatments are summarized in Table 1 wherein Eop-stage denotes the oxidized alkaline extraction with sodium hydroxide, hydrogen peroxide and oxygen, and Dabco denotes the prebleaching according to Example 1 with triethylenediamine (DABCO) and sodium hypochlorite.

The alkaline peroxide treatment decreased the kappa number by additional 0.7-1.7 units while the ISO brightness was increased by 4.2-7.0% units.

TABLE 1

| $E_{OP}$-stage | | | | | | Preceding Dabco-stage | | | | |
|---|---|---|---|---|---|---|---|---|---|---|
| NaOH kg/t | End pH | Kappa number | Brightness, % | Brightness gain, % | Δ Kappa | Act. Cl, kg/t | T, ° C. | End pH | Kappa number | Brightness, % |
| 3.0 | 9.3 | 5.1 | 66.4 | 1.7 | 1.7 | 10 | 50 | 4.0 | 6.8 | 59.4 |
| 6.5 | 10.4 | 5.5 | 63.6 | 1.5 | 1.5 | 10 | 65 | 3.8 | 7.0 | 59.1 |
| 6.3 | 10.4 | 7.4 | 60.6 | 1.6 | 1.6 | 5 | 50 | 4.0 | 9.0 | 56.4 |
| 3.3 | 10.7 | 7.1 | 60.3 | 1.3 | 1.3 | 5.2 | 50 | 8.3 | 8.4 | 56.1 |
| 3.3 | 10.5 | 5.6 | 66.7 | 0.7 | 0.7 | 10 | 50 | 8.7 | 6.3 | 62.0 |

Comparative Example 1

In comparison to the bleaching of Example 1 a conventional bleaching was performed using chlorine dioxide.

The same oxygen delignified Kraft pulp used in Example 1 was first treated with chlorine dioxide (2.1% by weight active chlorine on pulp) in 10% consistency in the medium consistency reactor. The reaction temperature was set to 60° C., reaction time was 40 min and the final pH was 2.8. After washing with deionized water, the treated pulp was subjected to a second bleaching treatment with sodium hydroxide (1.0% on pulp), hydrogen peroxide (1.5% on pulp) and oxygen (300 kPa) similarly to Example 2. The second treatment was carried out at 75° C. and it lasted for 90 min. The final pH was 10.95.

The kappa number was 7.4 after the treatment with chlorine dioxide which is to be compared with the values obtained for the Dabco-stage. The kappa number was 5.5 after the treatment with alkaline peroxide (Eop-stage). The ISO brightness was first increased to 69% and then to 73%.

Comparative Example 2

In comparison to the bleaching of Example 1 another conventional bleaching was performed using heat treatment.

The pH of a 10% suspension of the oxygen delignified Kraft pulp used in Example 1 was adjusted to 3.5 with sulfuric acid. The suspension was heated to 90° C. and kept for 140 min at this temperature before cooling it with cold water and washing it with deionized water. The washed pulp was subjected for a second bleaching treatment with sodium hydroxide, hydrogen peroxide (0.6% on pulp) and oxygen in conditions similar to Example 2. The final pH was 10.2. After washing with deionized water, the pulp was finally treated with chlorine dioxide (1.6% by weight active chlorine on pulp) in 10% consistency at 70° C. for 120 min, and the washed with deionized water. The final pH before washing was 3.9.

The kappa number was 10.5 after the acid treatment, 9.8 after the alkaline peroxide treatment and 4.6 after the chlorine dioxide treatment. The corresponding values of ISO brightness were 52, 55 and 70%.

The comparison of results from Example 1 and 2 with the Comparative examples 1 and 2 show that the initial bleaching i.e. initial reduction of kappa number of a birch Kraft pulp can be carried out more efficiently by using triethylenediamine catalyzed hypochlorite (Example 1) instead of chlorine dioxide as such or combined with a prior hot acid treatment that selectively degrades the amount of hexenuronic acid (Vuorinen, T et al., Selective Hydrolysis of Hexenuronic Acid Groups and its Applications in EFC and TCF Bleaching of Kraft Pulps, J. Pulp and Paper Science, 25:5 (1999) pp. 155-162.). When targeting at a constant kappa number after the initial bleaching, more than 50% less active bleaching chemical is needed in Example 2 compared to the conventional initial bleaching by Comparative example 1. The catalytic hypochlorite treatment of Example 1 i.e. 10 min or less is very fast in comparison with the slow acid hydrolysis of Comparative example 2 that most modern hardwood pulp bleaching lines use. Thus the catalytic bleaching of Examples 1 and 2 has a big advantage of requiring smaller investments in bleaching towers.

Example 3

The hexenuronic acid reaction rate in the amine catalyzed bleaching step was studied ex situ by removal of the possible disturbing factors present in the actual pulp processing.

A pure model compound of hexenuronic acid (0.2 mM aqueous solution), methyl 4-deoxy-β-L-threo-hex-4-enopyranosiduronic acid (synthesized as described in Adorjan, I. et al. Synthesis and characterization of the hexenuronic acid model methyl 4-deoxy-b-L-threo-hex-4-enopyranosiduronic acid, Carbohydrate Research 341:14 (2006) pp. 2439-2443), was treated with sodium hypochlorite (0.2 mM aqueous solution) separately in the absence and presence of triethylenediamine (0.005 mM aqueous solution). The reaction mixture was prepared in a pH 8 buffer solution. The reaction was monitored by measuring UV absorbance of the reaction mixture at 229 nm which represents the absorption maximum of hexenuronic acid.

Figure 4:
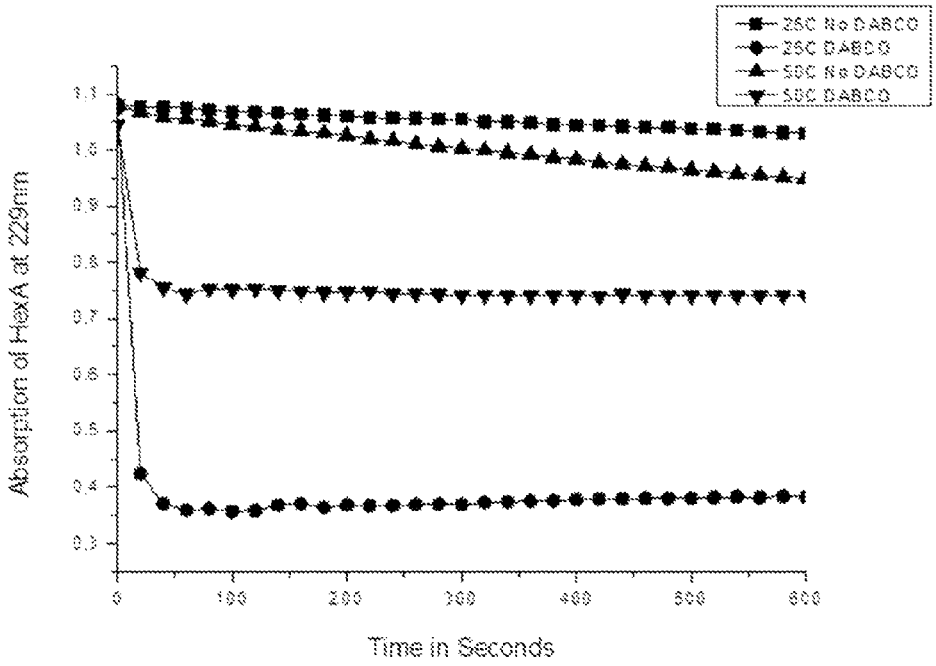
FIG. 4 shows the reaction rate of hexenuronic acid as a function of processing temperature.

In the presence of the amine catalyst the reaction was completed in less than a minute. Without the catalyst only a small fraction of hexenuronic acid was reacted within 10 min. FIG. 4 shows the decrease in the amount of hexenuronic acid in time as the reaction is proceeding. Due to the nature of the discrete UV absorbance measurements the first obtainable measurement points retrieved were at about tens of seconds.

When the measurements were repeated with higher amine catalyst concentrations (0.01 and 0.02 mM) the reaction was completed in 10 seconds. Similar results were obtained when the measurements were repeated in pH 4. FIG. 5 illustrates the total view whereby the different saturation levels of the two curves, with and without the amine catalyst, become evident. There is a striking time difference in reaching the hexenuronic acid final concentration level. FIG. 6 provides a close up view of the first 100 seconds of these two reactions.

Example 4

The lignin reaction rate in the amine catalyzed bleaching step was studied ex situ by removal of the possible disturbing factors present in the actual pulp processing. 3,4-Dimethoxytoluene (0.1 mM aqueous solution), representing the aromatic nature of lignin, was treated with sodium hypochlorite (0.1 mM aqueous solution) separately in the absence and presence of triethylenediamine (0.01 mM aqueous solution) in pH 4 at 25° C. The amount of residual active chlorine was monitored by measuring the UV absorbance of aliquots of the reaction mixture in an acid solution of potassium iodide (add reference). This method corresponds to the amount of residual lignin present after reaction with hypochlorite.

In the presence of the amine catalyst the reaction is completed very fast, in less than a minute, as illustrated by FIG. 7. Without the catalyst the reaction continued for half an hour.

Examples 3 and 4 demonstrate that triethylenediamine catalyzes the oxidation of hexenuronic and lignin at extremely low catalyst concentrations and very fast rate. In the bleaching experiments according to Example 1 the amine catalyst concentration was 1 mM. From the model compound measurements it can be estimated that the pulp bleaching reactions require only a few seconds to be completed although this could not be explicitly demonstrated at pulping conditions due to practical operation requirements such as opening of the reactor which takes several minutes.

The invention claimed is:

1. A method for bleaching pulp which pulp contains hexenuronic acid, lignin or corresponding aromatic chemical structures, wherein at least one tertiary amine compound of the general formula (1)

(1)

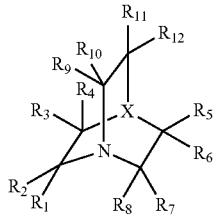

is introduced as catalyst into a process stage of bleaching that consists essentially of mixing pulp and a chlorine compound capable of bleaching, and wherein X is N or C, and $R_1$-$R_{12}$ is the same or different alkyl group, halide, ester, alkoxide or hydrogen wherein the amount of said tertiary amine compound is a catalytic amount from at least 0.01 kg/ton of pulp to less than 3 kg/ton of pulp.

2. The method according to claim 1, wherein said tertiary amine is selected from the group consisting of quinuclidine, triethylenediamine and a mixture thereof.

3. The method according to claim 1, wherein said tertiary amine compound is introduced as an aqueous solution.

4. The method according to claim 1, wherein said chlorine compound comprises chlorine dioxide, elemental chlorine, chlorite, hypochlorous acid or hypochlorite salts.

5. The method according to; claim 1, wherein said chlorine compound is selected from compounds forming hypochlorous acid in situ at said process stage.

6. The method according to claim 1, wherein said chlorine compound is introduced into said process stage after the introduction of said tertiary amine compound.

7. The method according to claim 5, wherein the amount of active chlorine present at said process stage is from 1 to 30 kg act. Cl/ton of pulp.

8. The method according to claim 1, wherein the temperature at said process stage is below 100° C.

9. The method according to claim 1, wherein said process stage is a chlorine dioxide bleaching stage.

10. The method according to claim 1, wherein said tertiary amine compound is recovered after bleaching at said process stage.

11. The method according to claim 1, wherein bleaching time at said process stage of bleaching is less than 10 min.

12. The method according to claim 8, wherein said tertiary amine compound is introduced as an aqueous solution.

13. The method of claim 7, wherein the amount of active chlorine present at said process stage is from 3 to 20 kg act. Cl/ton of pulp.

14. The method of claim 13, wherein the amount of active chlorine present at said process stage is from 5 to 15 kg act. Cl/ton of pulp.

15. The method of claim 8, wherein the temperature is below 90° C.

16. The method of claim 8 wherein the temperature is from 50 to 90° C.

17. The method according to claim 10, wherein said tertiary amine compound is reused or recycled or both.

18. The method according to claim 11, wherein the bleaching time is less than 5 min.

19. The method of claim 1, wherein the amount of said tertiary amine compound is a catalytic amount, less than 2 kg/ton, but at least 0.1 kg/ton.

* * * * *